US007281628B1

(12) United States Patent
Cheng

(10) Patent No.: US 7,281,628 B1
(45) Date of Patent: Oct. 16, 2007

(54) GOLF BAG HAVING A STAND FOR SUPPORTING A PLURALITY OF TEES

(76) Inventor: Wen-Chien Cheng, 4F, No. 8, Lane 153, Sec. 2, Chung Hsin Rd., Ta Li City, Taichung Hsien (TW)

( * ) Notice: Subject to any disclaimer, the term of this patent is extended or adjusted under 35 U.S.C. 154(b) by 170 days.

(21) Appl. No.: 11/158,122

(22) Filed: Jun. 21, 2005

(51) Int. Cl.
*A63B 55/06* (2006.01)
*A63B 57/00* (2006.01)

(52) U.S. Cl. ..... 206/315.7; 206/315.1; 206/315.3; 224/918; 248/96

(58) Field of Classification Search ..... 206/315.1, 206/315.7, 315.8, 315.3; 224/918; 248/96; 483/387; 473/387
See application file for complete search history.

(56) References Cited

U.S. PATENT DOCUMENTS 1,752,114 A * 3/1930 Shaw ..... 248/96
1,924,183 A * 8/1933 Fritz ..... 248/96
2,536,725 A * 1/1951 Cleveland ..... 211/86.01
2,593,042 A * 4/1952 Lynskey ..... 211/70.1
2,846,170 A * 8/1958 Huber ..... 248/96
3,298,579 A * 1/1967 Smith ..... 224/183
4,449,310 A * 5/1984 Kline ..... 40/658
4,498,615 A * 2/1985 Johnson ..... 224/274
4,506,854 A * 3/1985 Kim ..... 248/96
4,620,682 A * 11/1986 Yim ..... 248/96
4,730,728 A * 3/1988 Larkin ..... 206/315.9
4,739,958 A * 4/1988 Sato ..... 248/96
5,454,576 A * 10/1995 Pitkanen ..... 280/42

* cited by examiner

*Primary Examiner*—Sue A. Weaver
(74) *Attorney, Agent, or Firm*—Alan Kamrath; Kamrath & Associates PA

(57) ABSTRACT

A golf bag includes a bag body, a stand mounted on a side of the bag body, a plurality of tees mounted on an upper portion of the stand, and a plurality of sleeves each mounted on the mounting seat of the stand to support a respective one of the tees. Thus, each of the tees is clamped by the clamping pieces of each of the sleeves so that each of the tees is supported on the mounting seat of the stand rigidly and stably, thereby preventing the tees from being detached from the bag body.

6 Claims, 5 Drawing Sheets

GOLF BAG HAVING A STAND FOR SUPPORTING A PLURALITY OF TEES

BACKGROUND OF THE INVENTION

1. Field of the Invention

The present invention relates to a golf bag, and more particularly to a golf bag having a stand for supporting a plurality of tees.

2. Description of the Related Art

A conventional golf bag in accordance with the prior art shown in FIGS. 5 and 6 comprises a bag body 10, and an elastic strap 20 sewn onto a surface of the bag body 10 for supporting a plurality of tees 30. The elastic strap 20 has a plurality of hollow mounting portions 22 for mounting the tees 30. Each of the mounting portions 22 of the elastic strap 20 is sewn onto the bag body 10 by two stitching lines 21. However, the tees 30 not positioned by the mounting portions 22 of the elastic strap 20, so that the tees 30 are easily detached from the mounting portions 22 of the elastic strap 20, thereby causing inconvenience to the user. In addition, the elastic strap 20 is protruded outward from the surface of the bag body 10, thereby decreasing the outer appearance of the conventional golf bag.

SUMMARY OF THE INVENTION

The primary objective of the present invention is to provide a golf bag having a stand for supporting a plurality of tees.

Another objective of the present invention is to provide a golf bag, wherein each of the tees is clamped by the clamping pieces of each of the sleeves so that each of the tees is supported on the mounting seat of the stand rigidly and stably, thereby preventing the tees from being detached from the bag body.

A further objective of the present invention is to provide a golf bag, wherein the tees supported by the sleeves are arranged in a serial manner on the upper portion of the stand, thereby enhancing the outer appearance of the golf bag.

Further benefits and advantages of the present invention will become apparent after a careful reading of the detailed description with appropriate reference to the accompanying drawings.

DETAILED DESCRIPTION OF THE INVENTION

Figure 1:
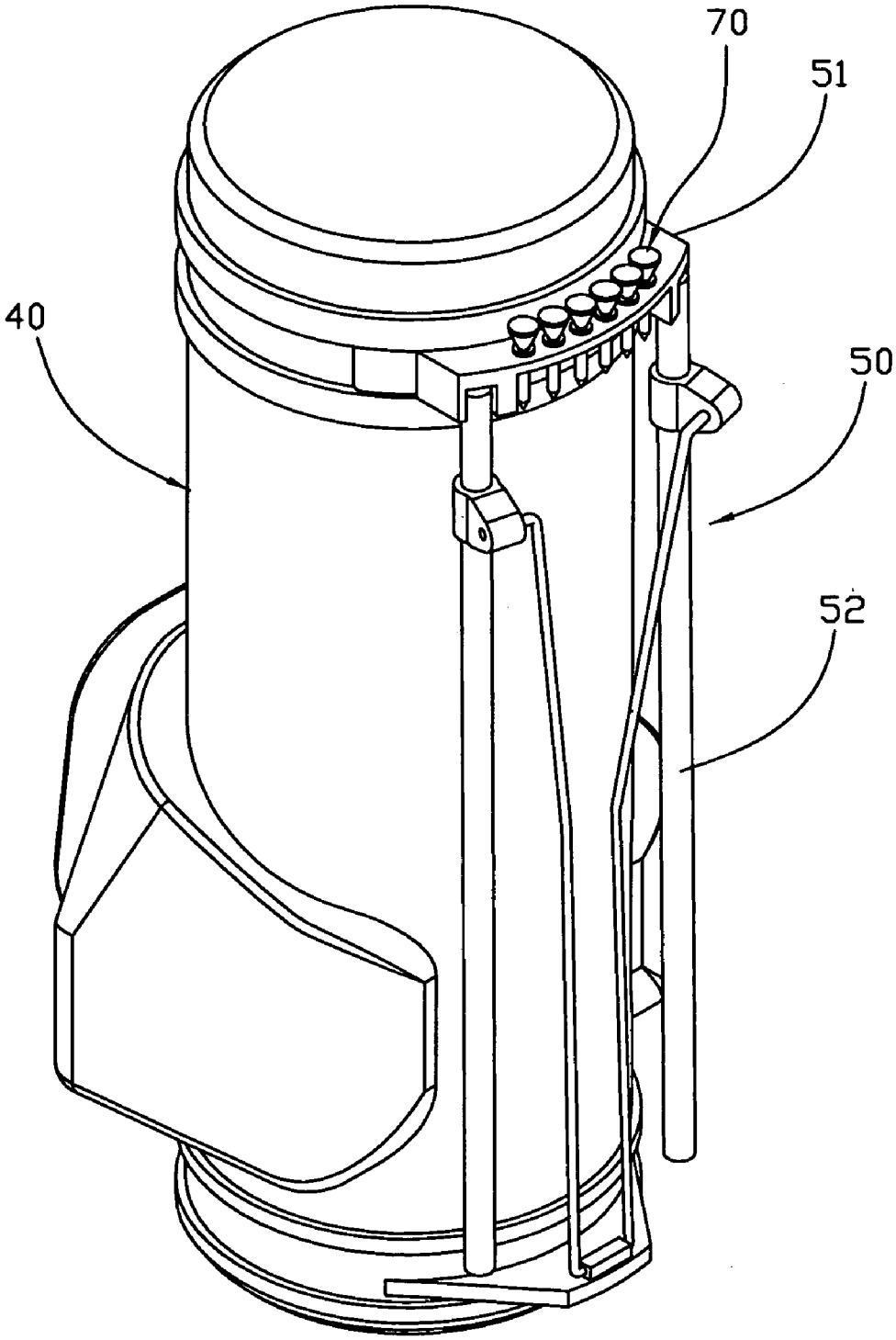
FIG. 1 is a perspective view of a golf bag in accordance with the preferred embodiment of the present invention.
Figure 2:
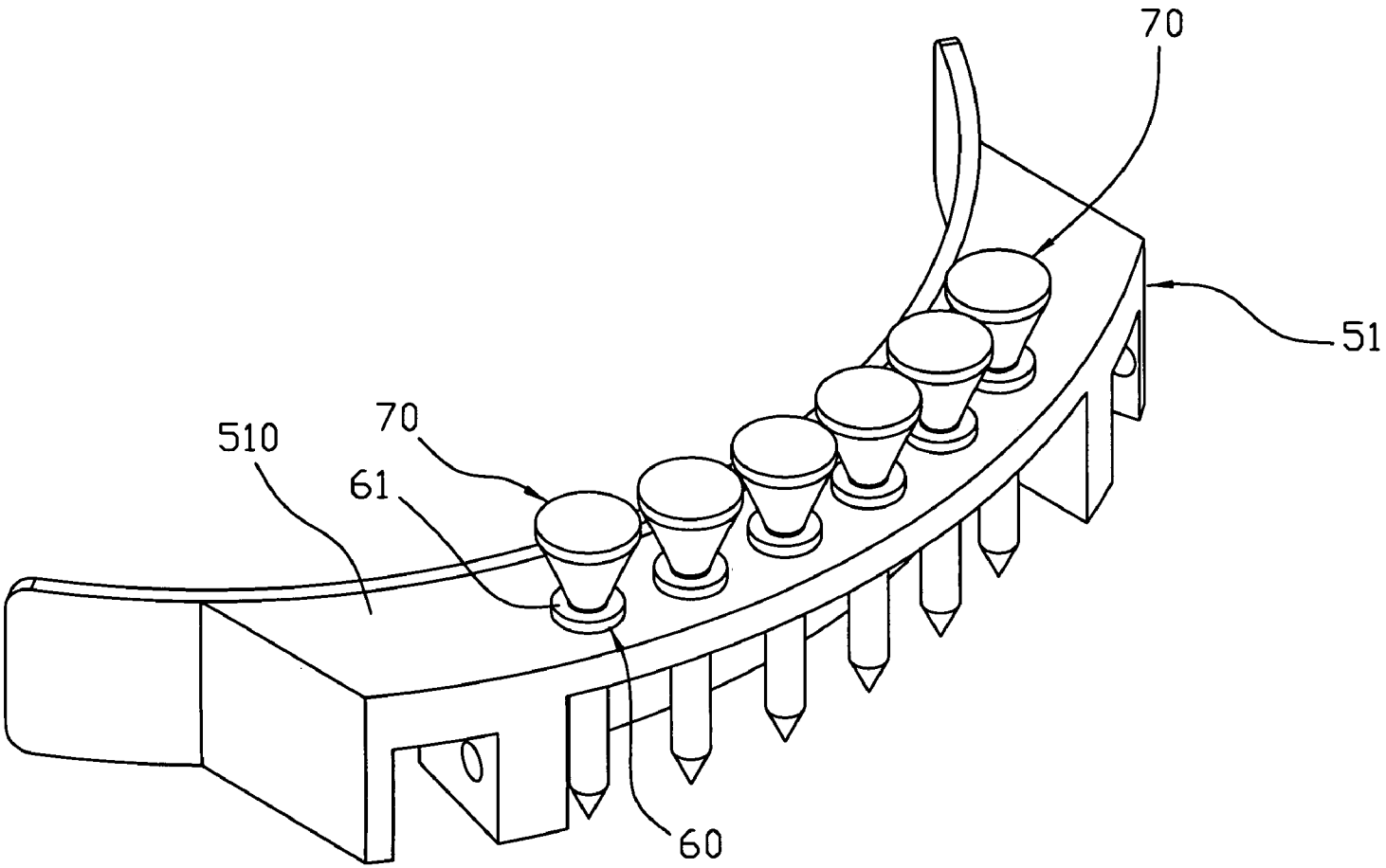
FIG. 2 is a partially perspective enlarged view of the golf bag as shown in FIG. 1.
Figure 3:
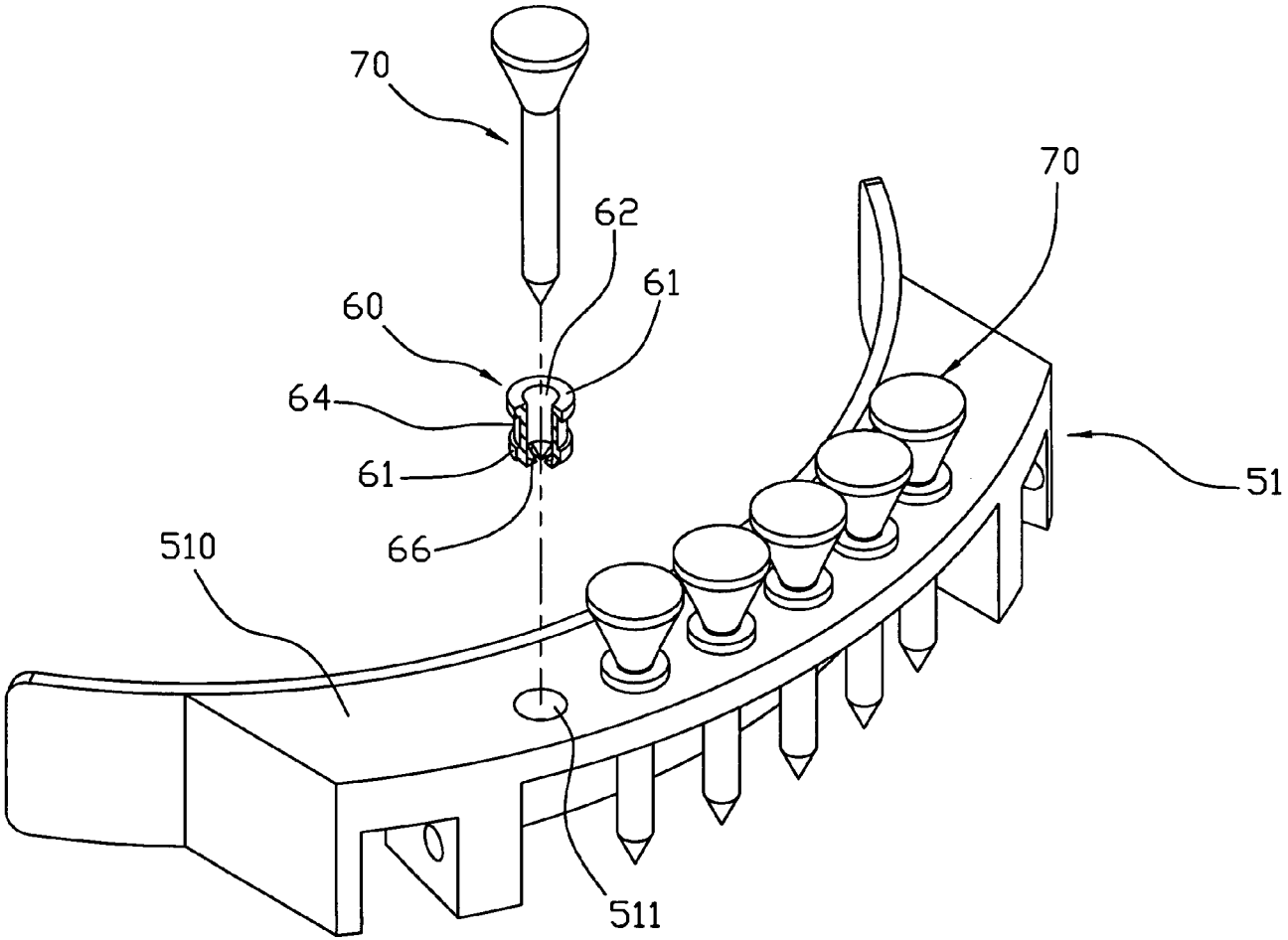
FIG. 3 is a partially exploded perspective view of the golf bag as shown in FIG. 2.
Figure 4:
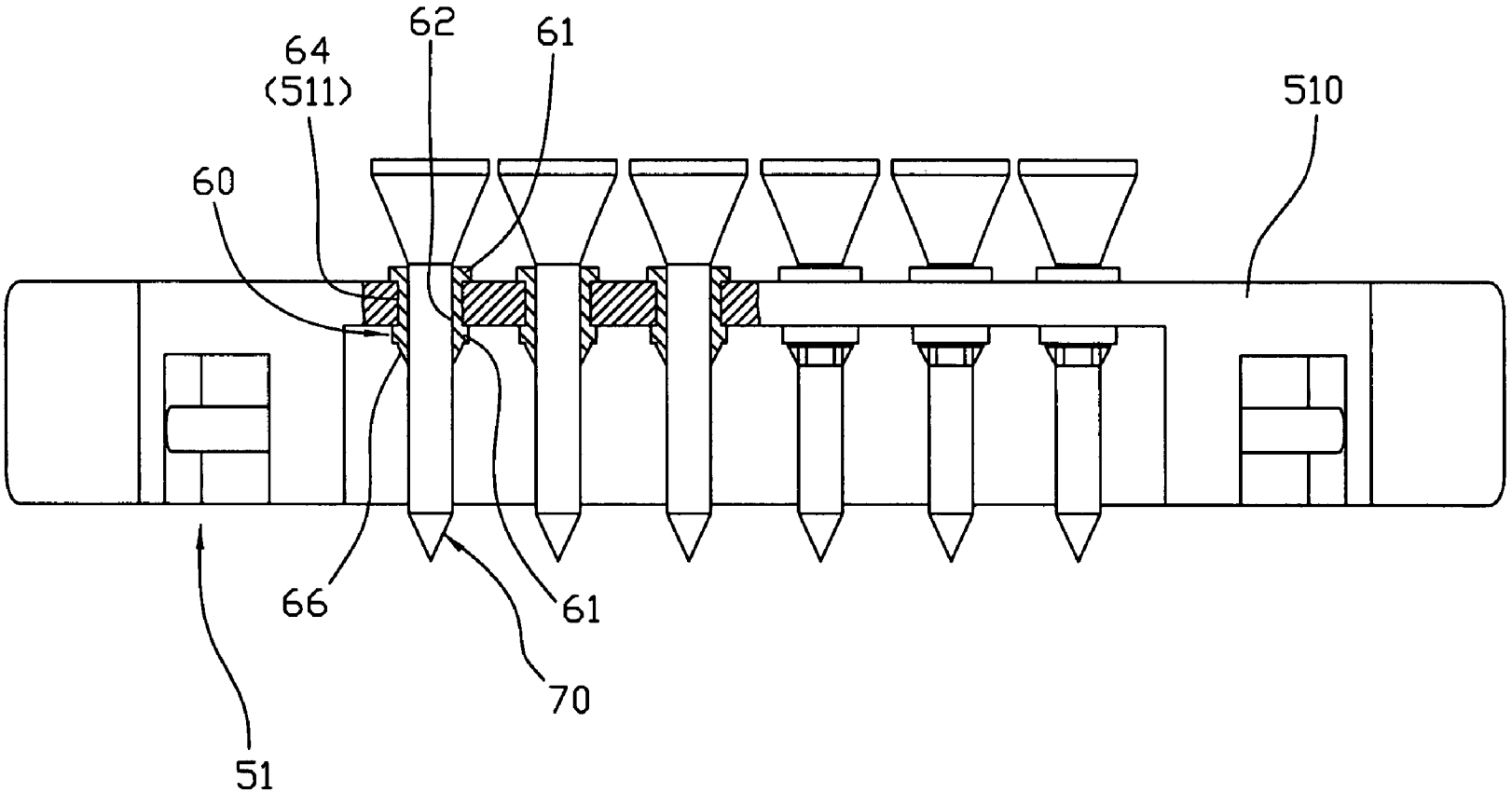
FIG. 4 is a partially plan cross-sectional view of the golf bag as shown in FIG. 2.
Figure 5:
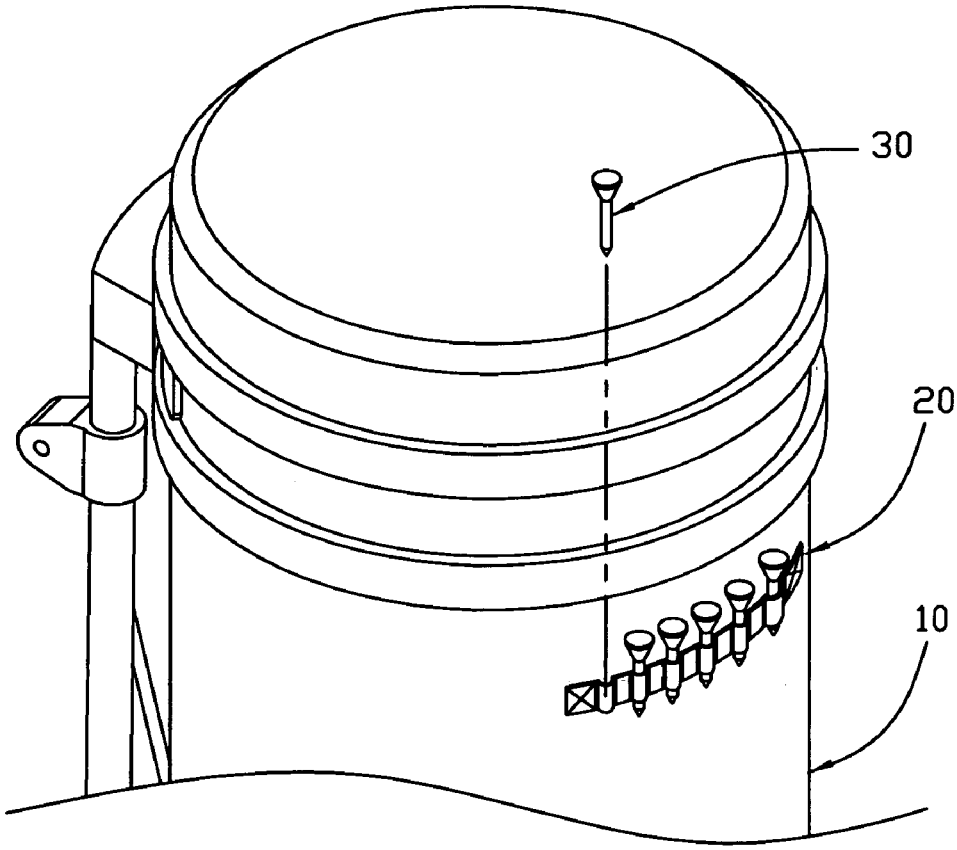
FIG. 5 PRIOR ART
FIG. 5 is a partially cut-away perspective view of a conventional golf bag in accordance with the prior art.
Figure 6:
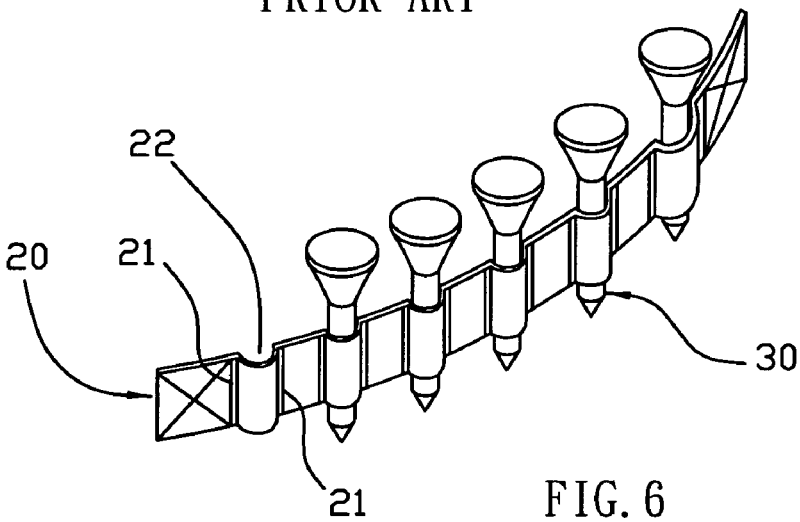
FIG. 6 PRIOR ART
FIG. 6 is a partially perspective enlarged view of the conventional golf bag as shown in FIG. 5.

Referring to the drawings and initially to FIG. 1, a golf bag in accordance with the preferred embodiment of the present invention comprises a bag body 40, a stand 50 mounted on a side of the bag body 40, and a plurality of tees

70 mounted on an upper portion of the stand 50. The stand 50 is provided with two pivotable support legs 52 that are pivoted outward to support the stand 50 on the ground.

Referring to FIGS. 1-4, the upper portion of the stand 50 is provided with a substantially arc-shaped mounting seat 51 secured to the bag body 40 for mounting the tees 70. The mounting seat 51 of the stand 50 has a surface formed with a sheet-shaped protruding mounting portion 510 formed with a plurality of mounting holes 511 for mounting the tees 70.

The golf bag further comprises a plurality of sleeves 60 each mounted in a respective one of the mounting holes 511 of the mounting seat 51 to support a respective one of the tees 70. Each of the sleeves 60 is forcibly inserted into the respective mounting hole 511 of the mounting seat 51 and has an inner wall formed with a mounting bore 62 to support the respective tee 70 and an outer wall formed with two annular retaining flanges 61 each protruded outward from and rested on a side of the mounting portion 510 of the mounting seat 51 and an annular retaining groove 64 located between the retaining flanges 61 and rested on a periphery of the respective mounting hole 511 of the mounting seat 51. The inner wall of each of the sleeves 60 has an end portion formed with a plurality of flexible clamping pieces 66 radially extended inward therefrom and clamped on the respective tee 70.

Preferably, the mounting seat 51 is integrally formed with the sleeves 60.

Accordingly, each of the tees 70 is clamped by the clamping pieces 66 of each of the sleeves 60 so that each of the tees 70 is supported on the mounting seat 51 of the stand 50 rigidly and stably, thereby preventing the tees 70 from being detached from the bag body 40. In addition, the tees 70 supported by the sleeves 60 are arranged in a serial manner on the upper portion of the stand 50, thereby enhancing the outer appearance of the golf bag.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A golf bag, comprising:

a bag body;

a stand mounted on a side of the bag body;

a plurality of tees mounted on an upper portion of the stand;

wherein the upper portion of the stand is provided with a mounting seat secured to the bag body for mounting the tees;

the mounting seat of the stand has a surface formed with a protruding mounting portion formed with a plurality of mounting holes for mounting the tees;

the golf bag further comprises a plurality of sleeves each mounted in a respective one of the mounting holes of the mounting seat to support a respective one of the tees;

each of the sleeves has an inner wall formed with a mounting bore to support the respective tee;

the inner wall of each of the sleeves has an end portion formed with a plurality of flexible clamping pieces radially extended inward therefrom and clamped on the respective tee.

2. The golf bag in accordance with claim 1, wherein the mounting portion of the mounting seat is substantially sheet-shaped.

3. The golf bag in accordance with claim 1, wherein the mounting seat of the stand is substantially arc-shaped.

4. The golf bag in accordance with claim 1, wherein each of the sleeves is forcibly inserted into the respective mounting hole of the mounting seat.

5. The golf bag in accordance with claim 1, wherein each of the sleeves has an outer wall formed with two annular retaining flanges each protruded outward from and rested on a side of the mounting portion of the mounting seat.

6. The golf bag in accordance with claim 5, wherein the outer wall of each of the sleeves is formed with an annular retaining groove located between the retaining flanges and rested on a periphery of the respective mounting hole of the mounting seat.

* * * * *